US010647538B2

(12) United States Patent
Tsunemi

(10) Patent No.: US 10,647,538 B2
(45) Date of Patent: May 12, 2020

(54) SHEET DISCHARGE DEVICE AND IMAGE FORMING APPARATUS THEREWITH

(71) Applicant: KYOCERA Document Solutions Inc., Osaka (JP)

(72) Inventor: Satoshi Tsunemi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/160,664

(22) Filed: Oct. 15, 2018

(65) Prior Publication Data

US 2019/0135570 A1 May 9, 2019

(30) Foreign Application Priority Data

Nov. 6, 2017 (JP) ..... 2017-213442

(51) Int. Cl.

| | |
|---|---|
| ***B65H 29/70*** | (2006.01) |
| ***B65H 37/00*** | (2006.01) |
| ***B65H 29/14*** | (2006.01) |
| ***B65H 29/12*** | (2006.01) |

(52) U.S. Cl.

CPC ..... *B65H 37/00* (2013.01); *B65H 29/125* (2013.01); *B65H 29/14* (2013.01); *B65H 29/70* (2013.01); *B65H 2301/5122* (2013.01); *B65H 2404/61* (2013.01); *B65H 2801/06* (2013.01)

(58) Field of Classification Search

CPC ..... B65H 2301/5121; B65H 2405/111; B65H 2405/1113; B65H 29/70; B65H 31/00; B65H 29/12; B65H 29/125; B65H 29/2301; B65H 29/5122; B65H 2403/41; B65H 2403/732; B65H 37/00; B65H 29/14; B65H 31/20; B65H 29/29; B65H 2301/5122

See application file for complete search history.

(56) References Cited

U.S. PATENT DOCUMENTS 8,991,817 B1 * 3/2015 Terao ..... B65H 29/70 271/188
2015/0091235 A1 * 4/2015 Noso ..... G03G 15/6573 271/3.2

FOREIGN PATENT DOCUMENTS

| | | | |
|---|---|---|---|
| JP | 2011-68445 | * | 4/2011 |
| JP | 2015-67416 A | | 4/2015 |
| JP | 2017-81686 | * | 5/2017 |

* cited by examiner

*Primary Examiner* — Thomas A Morrison
(74) *Attorney, Agent, or Firm* — Stein IP, LLC

(57) ABSTRACT

A sheet discharge device has a sheet discharge port, a conveying guide, discharge roller pairs, corrugation members, and first biasing members, and discharges sheets onto a discharge tray sequentially. The corrugation members are arranged between the discharge roller pairs to protrude beyond a nip portion in them and stiffens the sheet by pressing one side of the sheet. The first biasing members bias the corrugation members in the protruding direction. Each of the corrugation members has, in a region extending from the upstream side to a downstream-side end part of the discharge roller pairs in the sheet discharge direction and including the nip portion, a first pressing part making contact with one side of the sheet and, in a region further on the downstream side of the downstream-side end part of the discharge roller pairs, a second pressing part making contact with one side of the sheet.

12 Claims, 8 Drawing Sheets

SHEET DISCHARGE DEVICE AND IMAGE FORMING APPARATUS THEREWITH

INCORPORATION BY REFERENCE

This application is based upon and claims the benefit of priority from the corresponding Japanese Patent Application No. 2017-213442 filed on Nov. 6, 2017, the entire contents of which are incorporated herein by reference.

BACKGROUND

The present disclosure relates to a sheet discharge device which is used in image forming apparatuses such as copiers, printers, and facsimile machines and which discharges blank sheets or documents in the form of sheets, and to an image forming apparatus incorporating a sheet discharge device.

In image forming apparatuses using electrophotography, toner is attached to an electrostatic latent image formed on an image carrying member such as a photosensitive drum, and thereby a toner image is formed. The toner image is transferred to a recording medium in the form of a sheet, such as a blank sheet, and then the toner image on the sheet is fixed by a fixing device (fixing portion).

In such an image forming apparatus, a sheet heated and pressed by the fixing device can, depending on conditions, curl greatly. A curled sheet can obstruct a sheet discharge port and greatly humper sheets from being discharged onto a discharge tray in a neat, aligned stack, and can also push a previously stacked sheet in the discharge direction and cause it fall off from the discharge tray.

To avoid that, there have been proposed various methods for decurling a sheet. For example, there is known a sheet conveying device provided with a stiffening member which extends from a nip portion in a discharge roller pair to the upstream side in the sheet discharge direction and which stiffens a sheet by making contact with and pressing it.

SUMMARY

According to one aspect of the present disclosure, a sheet discharge device includes a sheet discharge port, a conveying guide, discharge roller pairs, corrugation members, and first biasing members, and discharges and stacks sheets onto a discharge tray sequentially. Through the sheet discharge port, a sheet is discharged. The conveying guide is composed of a first conveying guide facing one side of the sheet and a second conveying guide facing the other side of the sheet, and guides the sheet to the sheet discharge port. The discharge roller pairs are provided close to the sheet discharge port and are arranged at predetermined intervals in the sheet width direction perpendicular to the sheet discharge direction. The corrugation members are arranged between the discharge roller pairs so as to protrude from the first conveying guide side to the second conveying guide side beyond a nip portion in the discharge roller pairs, and stiffens the sheet by pressing one side of the sheet. The first biasing members are supported on the first conveying guide and bias the corrugation members in the protruding direction. Each of the corrugation members includes a first pressing part and a second pressing part. The first pressing part is arranged in a region extending from the upstream side of the discharge roller pairs to a downstream-side end part of the discharge roller pairs in the discharge direction and including the nip portion, and makes contact with one side of the sheet. The second pressing part is arranged in a region further on the downstream side of the downstream-side end part of the discharge roller pairs in the discharge direction, and makes contact with one side of the sheet.

Further features and advantages of the present disclosure will become apparent from the description of embodiments given below.

DETAILED DESCRIPTION

Figure 1:
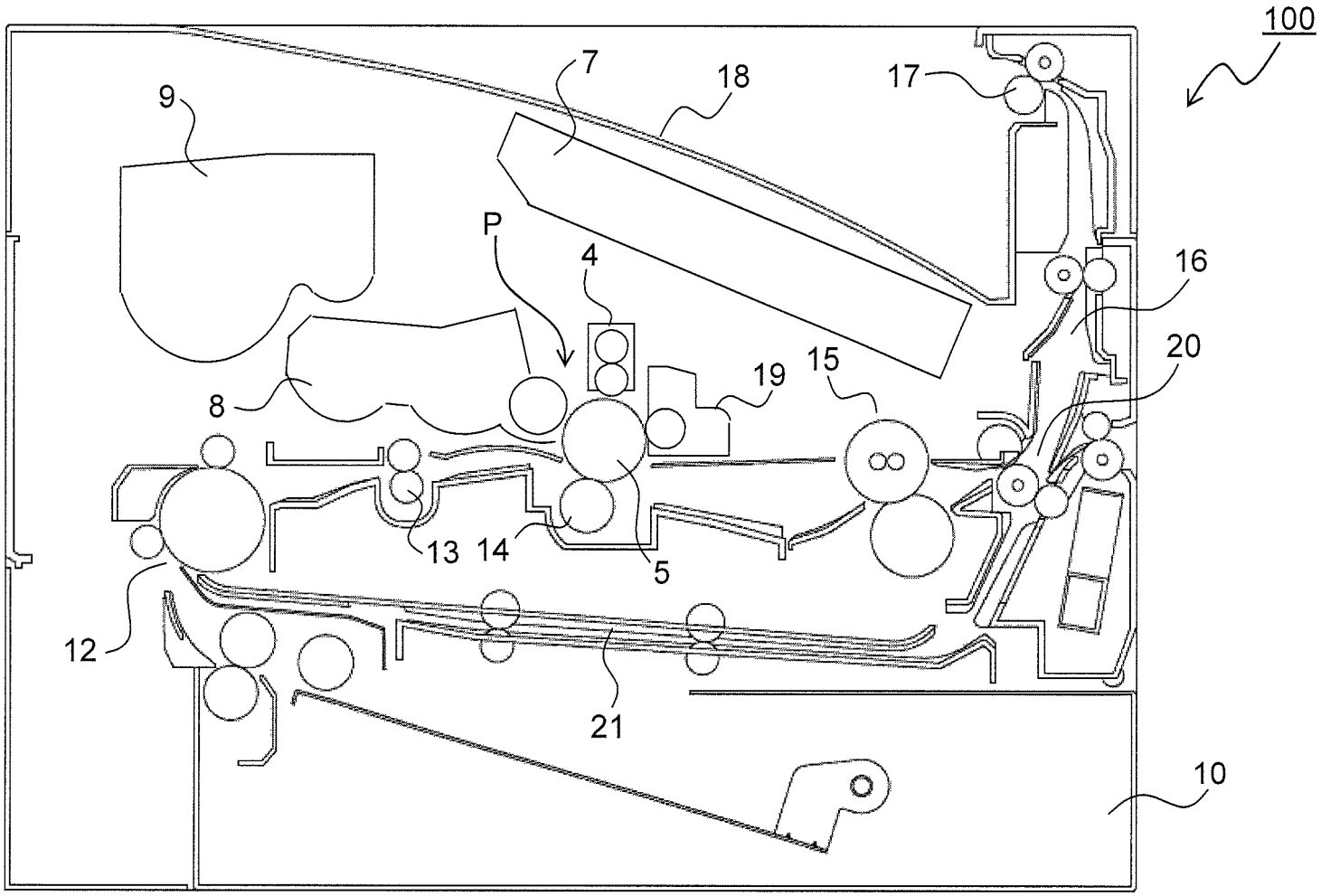
FIG. 1 is a side sectional view showing an internal construction of an image forming apparatus incorporating a sheet discharge device according to the present disclosure.

Hereinafter, with reference to the accompanying drawings, an embodiment of the present disclosure will be described. FIG. 1 is a side sectional view showing an internal construction of an image forming apparatus 100 incorporating a sheet discharge device 30 (see FIG. 2) according to one embodiment of the present disclosure. As shown in FIG. 1, inside the image forming apparatus 100 (for example, a monochrome printer), an image forming portion P is arranged which forms a monochrome image through the processes of charging, exposure, developing, and transferring. In the image forming portion P, along the rotation direction of a photosensitive drum 5 (the clockwise direction in FIG. 1), there are arranged a charging unit 4, an exposing unit (laser scanning unit, etc.) 7, a developing unit 8, a transfer roller 14, a cleaning device 19, and a static eliminator (unillustrated).

When image formation is performed, the photosensitive drum 5 rotating in the clockwise direction is electrostatically charged by the charging unit 4 uniformly. Next, an electrostatic latent image is formed on the photosensitive drum 5 by a laser beam from the exposing unit 7 based on document image data, and developer (hereinafter, referred to as toner) is attached to the electrostatic latent image by the developing unit 8, so that a toner image is formed.

The toner is fed to the developing unit 8 from a toner container 9. The image data is transmitted from a personal computer (unillustrated) or the like. The static eliminator (unillustrated) removing electric charge remaining on the surface of the photosensitive drum 5 is provided on the downstream side of the cleaning device 19.

Toward the photosensitive drum 5 having the toner image formed on it as described above, a sheet is conveyed from a sheet feed cassette 10 via a sheet conveying passage 12 and a registration roller pair 13. The toner image formed on the surface of the photosensitive drum 5 is transferred to the sheet by the transfer roller 14 (image transfer portion). The sheet having the toner image transferred to it is separated from the photosensitive drum 5, and is conveyed to a fixing device 15, so that the toner image is fixed.

The sheet having passed the fixing device 15 and a conveying roller pair 23 is conveyed to an upper part of the image forming apparatus 100 through a sheet conveying passage 16. When an image is formed only on one side of a sheet (during single-sided printing), the sheet is discharged onto a discharge tray 18 via discharge roller pairs 17 in the sheet discharge device 30 (see FIG. 2).

On the other hand, when images are formed on both sides of a sheet (during double-sided printing), after the tail end of the sheet passes a branching portion 20 of the sheet conveying passage 16, the discharge roller pairs 17 are rotated in the reverse direction so that the conveying direction is reversed. Thus, the sheet is distributed to a reversed conveying passage 21 from the branching portion 20, and is conveyed, with the image side reversed, once again to the registration roller pair 13. Then, the next toner image formed on the photosensitive drum 5 is transferred by the transfer roller 14 to the side of the sheet having no image formed on it. The sheet having the toner image transferred to it is conveyed to the fixing device 15, where the toner image is fixed, and is then discharged onto the discharge tray 18 via the discharge roller pairs 17.

Figure 2:
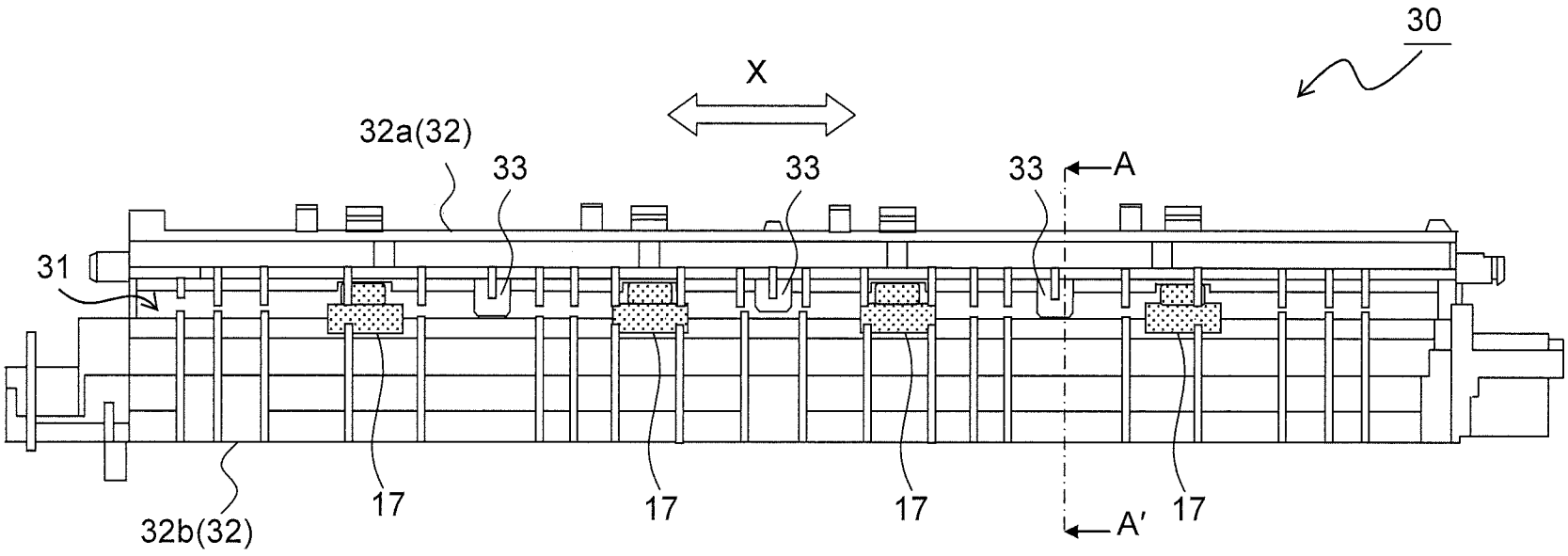
FIG. 2 is a front view, as seen from the downstream side in the sheet discharge direction, of the sheet discharge device according to a first embodiment of the present disclosure.

FIG. 2 is a front view of a sheet discharge device 30 according to a first embodiment of the present disclosure that is incorporated in the image forming apparatus 100, as seen from the downstream side in the sheet discharge direction (the left side in FIG. 1). The sheet discharge device 30 includes a sheet discharge port 31, a conveying guide 32 comprising an upper conveying guide 32*a* and a lower conveying guide 32*b* guiding a sheet to the sheet discharge port 31, the discharge roller pairs 17, and corrugation members 33.

The discharge roller pairs 17 are arranged, close to the sheet discharge port 31 on its upstream side, in four pairs approximately equally spaced in the sheet width direction (arrow-X direction in FIG. 2). The discharge roller pairs 17 discharge the sheet conveyed from the sheet conveying passage 16 onto the discharge tray 18 (see FIG. 1). Each of the discharge roller pairs 17 is composed of a rubber discharge roller 17*a* which can rotate forward and backward by being driven a driving motor (unillustrated) and a resin discharge roll 17*b* (see FIG. 3 for both) which rotates by following the discharge roller 17*a*.

Between the discharge roller pairs 17, corrugation members 33 are arranged which press the top face of the sheet discharged from the sheet discharge port 31. The corrugation members 33 are supported on the upper conveying guide 32*a* so as to be movable in the up-down direction and are biased downward by compression springs 34 (a first biasing member, see FIG. 3).

Figure 3:
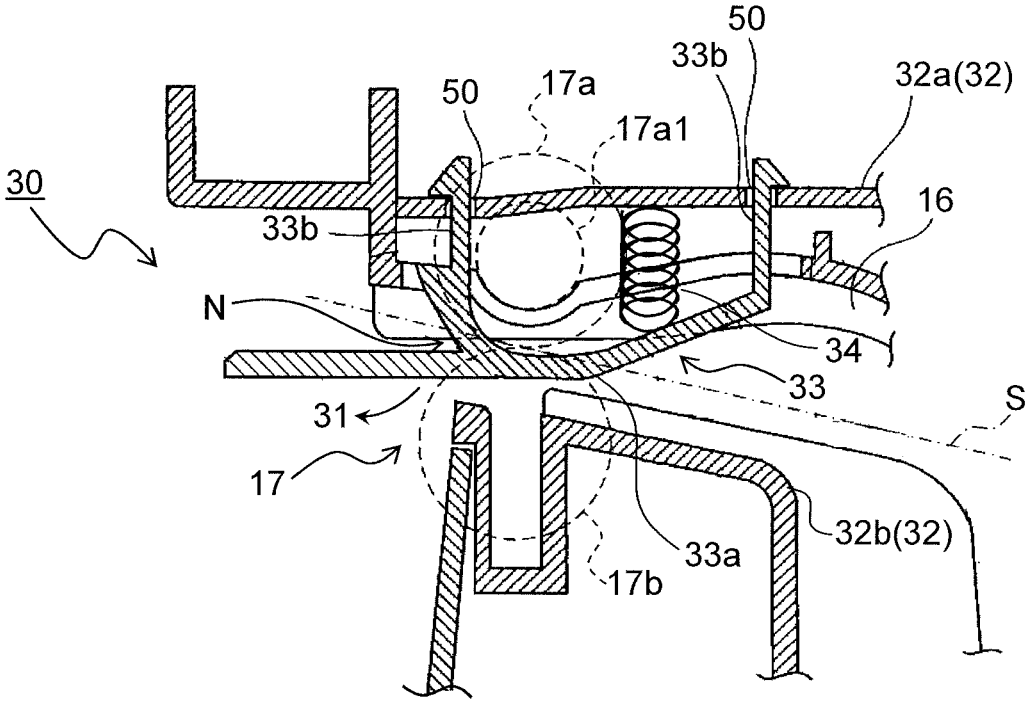
FIG. 3 is a side sectional view of the sheet discharge device according to the first embodiment.

FIG. 3 is a side sectional view (a sectional view across place A-A' in FIG. 2 as seen from the direction indicated by arrows) of a sheet discharge device 30 according to the first embodiment that includes a corrugation member 33. As shown in FIG. 3, a bottom end part 33*a* of the corrugation member 33 is located below a nip portion N in the discharge roller pairs 17. The structure of the corrugation member 33 will be described in detail later.

A sheet S discharged from the sheet discharge port 31 is nipped by the nip portion N in the discharge roller pairs 17 and is pressed to below the nip portion N by the bottom end part 33*a* of the corrugation member 33. As a result, the sheet S is curved into a corrugated shape as seen from the discharge direction and is discharged, in a stiffened state, onto the discharge tray 18. Thus, it is possible to prevent the sheet S from being discharged with the head end of the sheet S hanging down under its own weight and being stacked in a curled state with its head end caught on the top face of the discharge tray 18.

Figure 4:
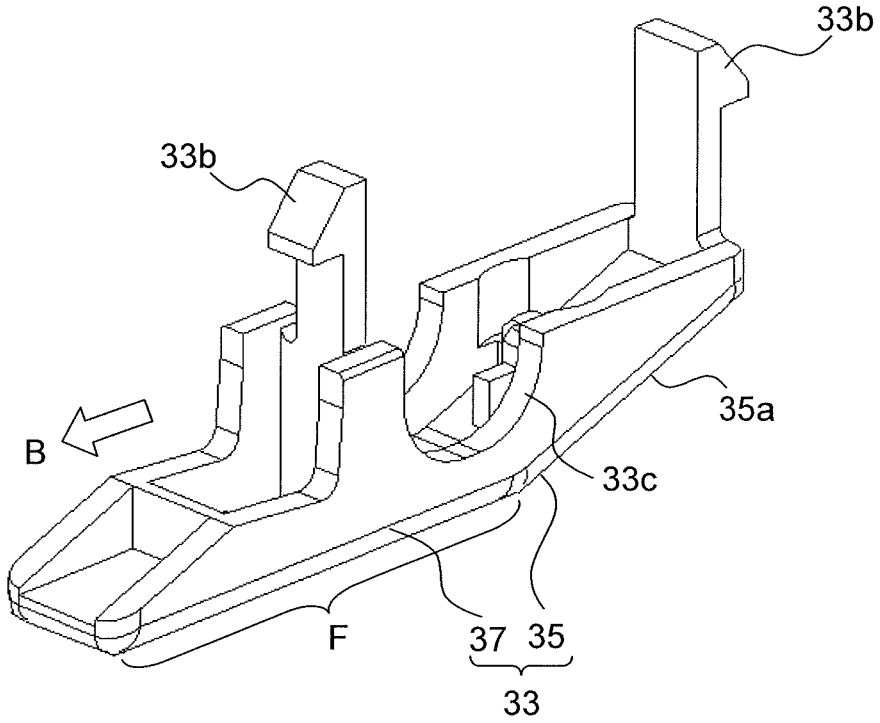
FIG. 4 is a perspective view of a corrugation member used in the sheet discharge device according to the first embodiment.
Figure 5:
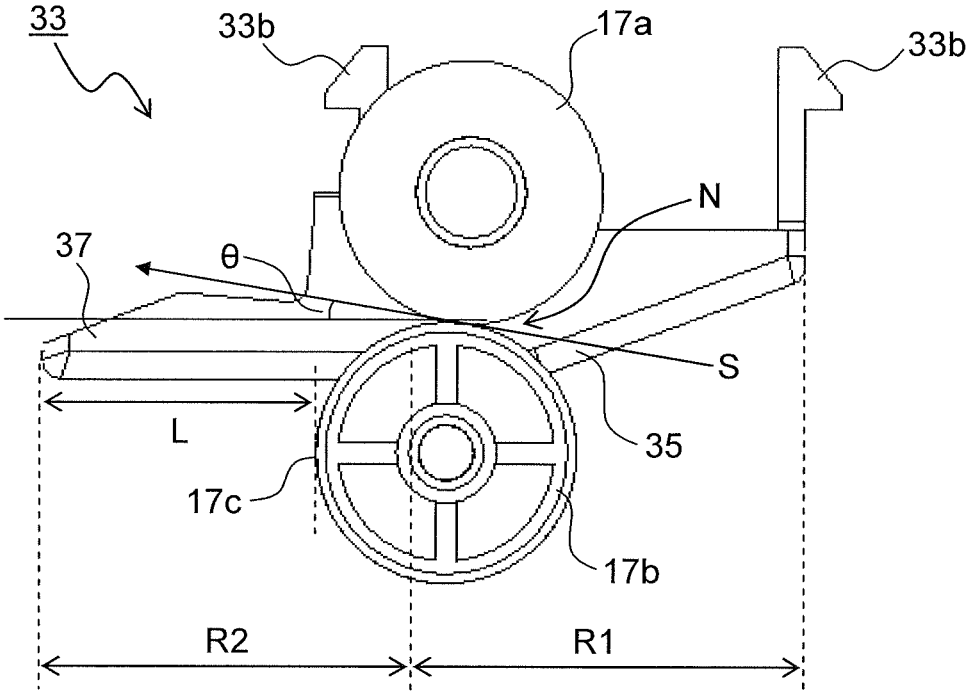
FIG. 5 is a side view showing a positional relationship between a discharge roller pair and the corrugation member in the sheet discharge device according to the first embodiment.

FIG. 4 is a perspective view of the corrugation member 33 used in the sheet discharge device 30 according to the first embodiment, as seen from the downstream side in the sheet discharge direction. FIG. 5 is a side view showing a positional relationship, in the sheet discharge device 30 according to the first embodiment, between the discharge roller pairs 17 and the corrugation members 33. Although FIGS. 4 and 5 show the corrugation member 33 which is arranged at one end (the right end in FIG. 2) of the sheet discharge port 31, the corrugation members 33 which are arranged at the middle and the other end of the sheet discharge port 31 have quite the same structure.

The corrugation member 33 is made of resin, and has a first pressing part 35 and a second pressing part 37. The first pressing part 35 makes contact with the top face of a sheet over a region R1 extending from the upstream side of the discharge roller pairs 17 to a downstream-side end part 17*c* of the discharge roller pairs 17 in the sheet discharge direction (arrow-B direction in FIG. 4) and including the nip portion N. The second pressing part 37 protrudes to the downstream side of the downstream-side end part 17*c* of the discharge roller pairs 17 in the sheet discharge direction. The second pressing part 37 makes contact with the top face of the sheet over a region R2 that is continuous with the downstream side of the region R1 and that protrudes to the downstream side of the downstream-side end part 17*c* of the discharge roller pairs 17.

The first pressing part 35 includes an inclined face 35*a* inclining downward from the upstream side to the downstream side in the sheet conveying direction. A downstream-side end part of the inclined face 35*a* in the sheet discharge direction is located below the nip portion N in the discharge roller pairs 17. The first pressing part 35 includes an arc-shaped cutout portion 33*c* for preventing interference with a rotary shaft 17*a*1 (see FIG. 3) of the discharge roller 17*a* and two engagement claws 33*b* protruding upward. The engagement claws 33*b* engage engagement holes 50 (see FIG. 3) formed in the upper conveying guide 32*a*.

The second pressing part 37 is integrally formed of the same resin material as the first pressing part 35. The second pressing part 37 includes a pressing face F extending approximately horizontally from a bottom end part of the inclined face 35*a* of the first pressing part 35 further to its downstream side.

With the configuration according to this embodiment, the head end of the sheet S conveyed through the sheet conveying passage 16 makes contact with the inclined face 35*a* formed in the first pressing part 35 of the corrugation member 33. Then, the sheet S is smoothly conveyed to the downstream side in the discharge direction while being pressed downward along the inclined face 35*a*. When the head end of the sheet S reaches the nip portion N in the discharge roller pairs 17, by the first pressing part 35 protruding to below the nip portion N, the sheet S comes to take a corrugated shape along the width direction. Thus, the sheet S is stiffened.

When the sheet S continues to be discharged, the sheet S in the corrugated shape is kept by the second pressing part 37 continuous with the first pressing part 35. Thus, the sheet S is discharged onto the discharge tray 18 with the corrugated shape being maintained, and it is possible to effectively suppress curling of the sheet S.

The sheet S in the corrugated shape can be maintained long by the second pressing part 37, and thus if the pressing force acting on the sheet S from the corrugation member 33 (the biasing force of the compression spring 34) is reduced, it is possible to maintain an effect of preventing the sheet S from curling. As a result, damage to the sheet S is reduced, and it is possible to suppress development of streaks in the conveying direction.

For example, in a conventional corrugation member 33 without the second pressing part 37, the biasing force of the compression spring needs to be at 0.6 N to suppress curling of the sheet S. By contrast, in the corrugation member 33 according to this embodiment including the second pressing part 37, even when the biasing force of the compression spring is reduced to 0.4 N, it is possible to obtain an effect of preventing curling similar to that obtained conventionally.

There is no particular limitation on the protrusion length L of the second pressing part 37 extending from the downstream-side end part 17*c* of the discharge roller pairs 17, but if the protrusion length L is too small, it is impossible to sufficiently maintain the sheet S in the corrugated shape, and this reduces the effect of suppressing the sheet S from curling. On the other hand, making the protrusion length L larger than a certain length does not improve the effect of maintaining the corrugated shape but rather makes it difficult to take out a sheet S jammed near the sheet discharge port 31 during jam handling, and this may lead to reduced operability. To avoid that, the protrusion length L is made as small as possible while giving a necessary and sufficient effect of maintaining the corrugated shape; it is then possible to suppress curling of the sheet S without so much reducing operability in jam handling.

The optimal value of the protrusion length L varies with the height from the discharge roller pairs 17 to the discharge tray 18 and the discharge angle of the sheet S (the angle θ in FIG. 5) from the discharge roller pairs 17. In this embodiment, it is assumed that the discharge angle θ is 5° and that the protrusion length L is 20 mm. In this embodiment, as compared with the discharge roller 17*a*, the discharge roll 17*b* is located further on the downstream side in the sheet discharge direction, and thus the protrusion length L from the downstream-side end part 17*c* of the discharge roll 17*b* is defined. In a case where, as compared with the discharge roll 17*b*, the discharge roller 17*a* is located further on the downstream side in the sheet discharge roller direction, the protrusion length L from the downstream-side end part of the discharge roller 17*a* can be defined.

Figure 6:
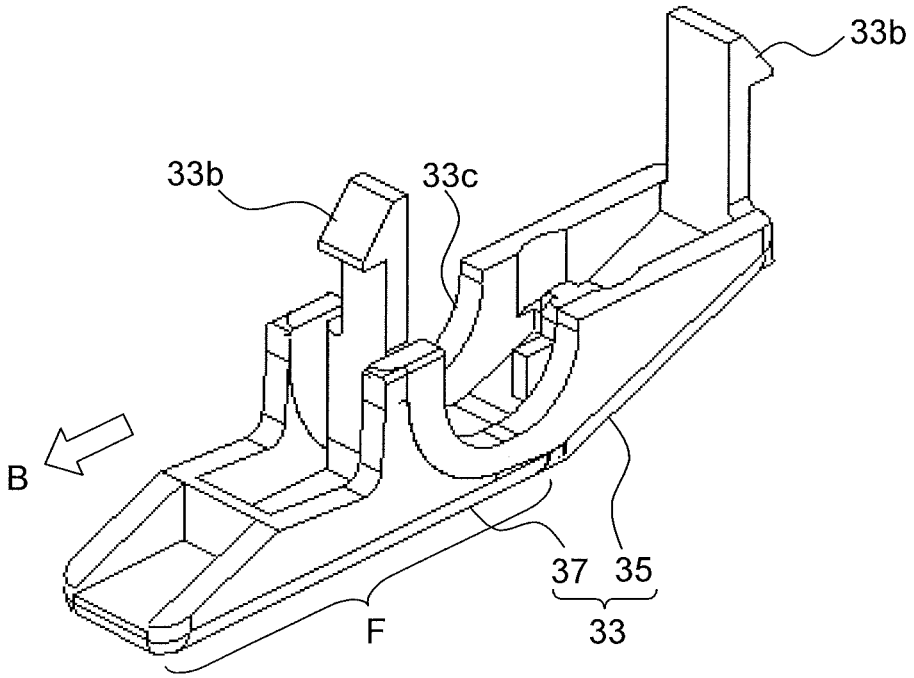
FIG. 6 is a perspective view of the corrugation member used in the sheet discharge device according to a second embodiment of the present disclosure.
Figure 7:
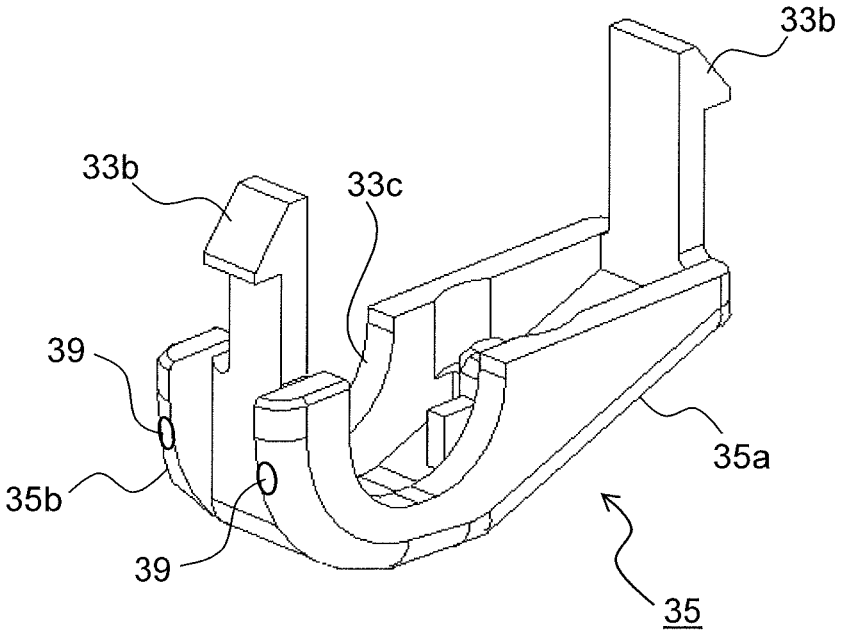
FIG. 7 is a perspective view of a first pressing part of the corrugation member in FIG. 6.
Figure 8:
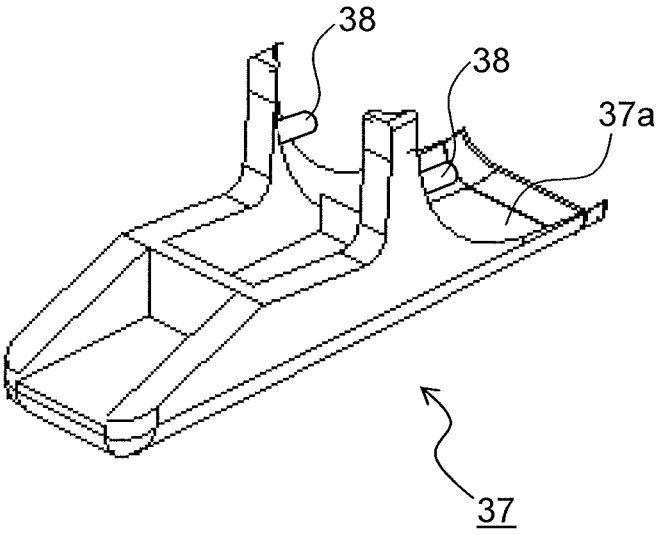
FIG. 8 is a perspective view of a second pressing part of the corrugation member in FIG. 6.

FIG. 6 is a perspective view of a corrugation member 33 used in a sheet discharge device 30 according to a second embodiment of the present disclosure, as seen from the downstream side in the sheet discharge direction. FIGS. 7 and 8 are perspective views of a first pressing part 35 and a second pressing part 37, respectively, comprising the corrugation member 33. In this embodiment, the first pressing part 35 and the second pressing part 37 are formed as separate members, and the second pressing part 37 is removably attached to the first pressing part 35. In other respects, the corrugation member 33 here has the same structure as in the first embodiment.

The first pressing part 35 forms the main body part of the corrugation member 33, and has a cutout portion 33*c* and two engagement claws 33*b*. A downstream-side end part 35*b* of the first pressing part 35 has an outer circumferential edge formed into a convex shape (convex part) with an arc shape as seen in a side view.

An upstream-side end part 37*a* of the second pressing part 37 is formed into a concave shape (concave part) with an arc shape as seen in a side view, making contact with the downstream-side end part 35*b* of the first pressing part 35. On the upstream-side end part 37*a*, two engagement protrusions 38 are formed which protrude toward the first pressing part 35. In the downstream-side end part 35*b* of the first pressing part 35, two engagement holes 39 are formed at positions facing the engagement protrusions 38. Inserting the engagement protrusions 38 in the engagement holes 39 permits the second pressing part 37 to be held in a state where it is mounted on the first pressing part 35.

With the construction according to this embodiment, the second pressing part 37 is removable from the corrugation member 33, and thus it is possible to change the degree of stiffening applied by the corrugation member 33 according to the thickness, type, and the like of the sheet S. For example, in a case where the sheet S is regular paper or thin paper which is less prone to be stiffened, so that the corrugated shape is maintained long, the sheet is discharged with the second pressing part 37 mounted. On the other hand, in a case where the sheet S is thick paper which is unlikely to curl even without being stiffened, the sheet is discharged with the second pressing part 37 removed. In this way, damage to sheets S is reduced, and sheets S can be discharged onto a discharge tray 18 in a neat, aligned stack.

The downstream-side end part 35*b* of the first pressing part 35 is formed arc-shaped. Thus, it is possible to suppress development of streaks resulting from the sheet S discharged with the second pressing part 37 removed being rubbed against the downstream-side end part 35*b*.

Figure 9:
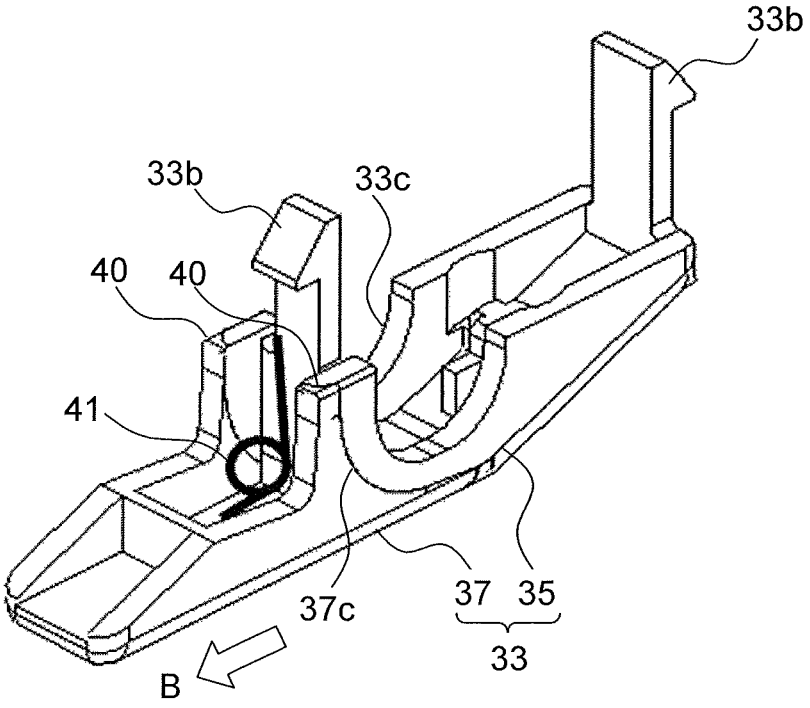
FIG. 9 is a perspective view of the corrugation member used in the sheet discharge device according to a third embodiment of the present disclosure.
Figure 10:
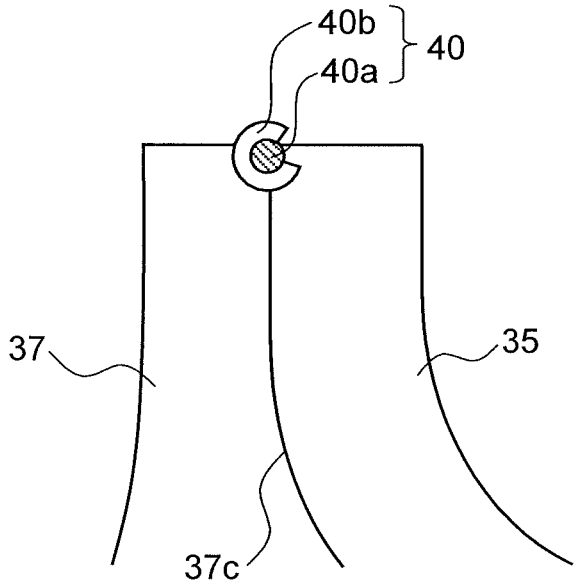
FIG. 10 is a partly enlarged view around a hinge part provided between the first pressing part and the second pressing part of the corrugation member used in the sheet discharge device according to the third embodiment.
Figure 11:
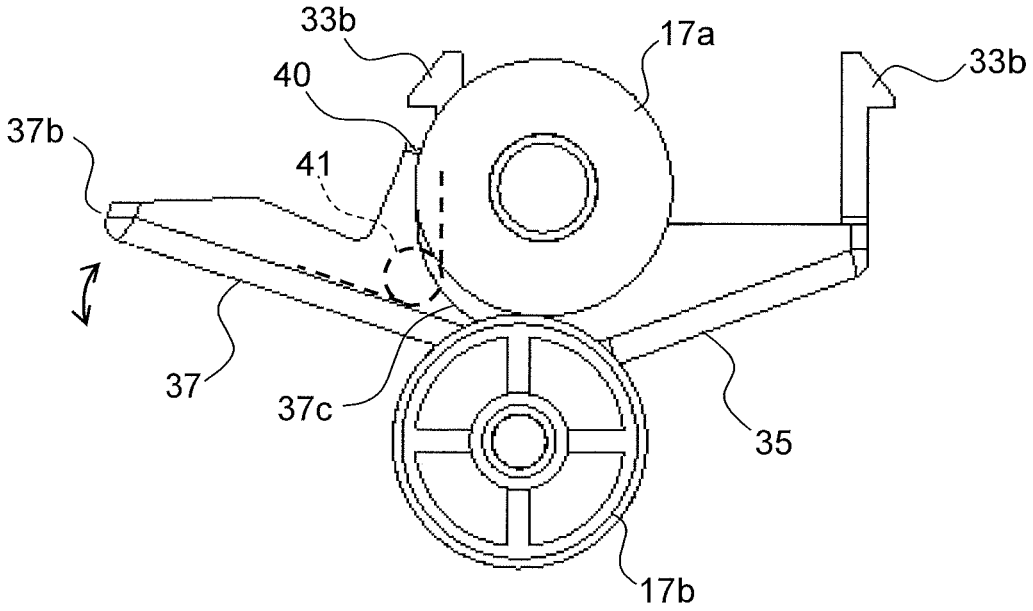
FIG. 11 is a side view showing a positional relationship between the discharge roller pair and the corrugation member in the sheet discharge device according to the third embodiment.

FIG. 9 is a perspective view of a corrugation member 33 used in a sheet discharge device 30 according to a third embodiment of the present disclosure, as seen from the downstream side in the sheet discharge direction. FIG. 10 is a partly enlarged view around a hinge part 40 provided between a first pressing part 35 and a second pressing part 37 of the corrugation member 33 used in the sheet discharge device 30 according to the third embodiment. FIG. 11 is a side view showing a positional relationship, in the sheet discharge device 30 according to the third embodiment, between discharge roller pairs 17 and the corrugation member 33. In this embodiment, the second pressing part 37 is supported, in the hinge part 40 at the top end of a connection part 37*c*, on a downstream-side end part 35*b* of the first pressing part 35 so as to be swingable in the up/down direction. Between the first pressing part 35 and the second pressing part 37, a torsion spring 41 (a second biasing member) is arranged which biases the second pressing part 37 downward.

As shown in FIG. 10, the hinge part 40 is composed of a hinge shaft 40*a* which is provided at the top end of the first pressing part 35, and a hinge bearing 40*b* which is provided at the top end of the second pressing part 37 and which swingably engages with the hinge shaft 40*a*.

With the construction according to this embodiment, owing to a downstream-side end part 37*b* of the second pressing part 37 swinging in the up/down direction, when a sheet S is discharged, it is pressed downward by the second pressing part 37 arranged at the lower limit position (position in FIG. 9), and the corrugated shape is maintained long; thus it is possible to suppress curling of the sheet S. The second pressing part 37 is biased downward (toward the lower limit position) by the torsion spring 41; this prevents the effect of stiffening from being reduced as a result of the second pressing part 37 being pushed up and swung upward when a sheet S is discharged. When a jam is handled, the second pressing part 37 is swung upward and is retracted from a sheet discharge port 31 as shown in FIG. 11, and then the sheet S jammed around the sheet discharge port 31 can be removed easily.

The biasing force from the torsion spring 41 acts on the second pressing part 37, so that from the second pressing part 37 the pressing force (the biasing force of the torsion spring 41) acts on the sheet S. Here, the second pressing part 37 presses the sheet S at a position away from a nip portion N in discharge roller pairs 17 to the downstream side in the discharge direction. That is, the second pressing part 37 presses the sheet S in a state where the sheet S is released from the nipping by the nip portion N in the discharge roller pairs 17, and thus damage is unlikely to be done to the sheet S. In this embodiment, it is assumed that the biasing force of the compression spring 34 is 0.4 N and that the biasing force of the torsion spring 41 is 0.2 N.

In addition, by selecting the biasing force of the torsion spring 41 (spring constant) appropriately, with the second pressing part 37 mounted, it is possible to produce an effect of stiffening that suits the type of the sheet S. For example, in a case where the sheet S discharged is regular paper or thin paper, owing to the second pressing part 37 being arranged at the lower limit position by the biasing force of the torsion spring 41, the effect of stiffening is enhanced. On the other hand, in a case where the sheet S discharged is thick paper, owing to the second pressing part 37 in contact with the sheet S being swung upward against the biasing force of the torsion spring 41, damage to the sheet S is reduced.

Figure 12:
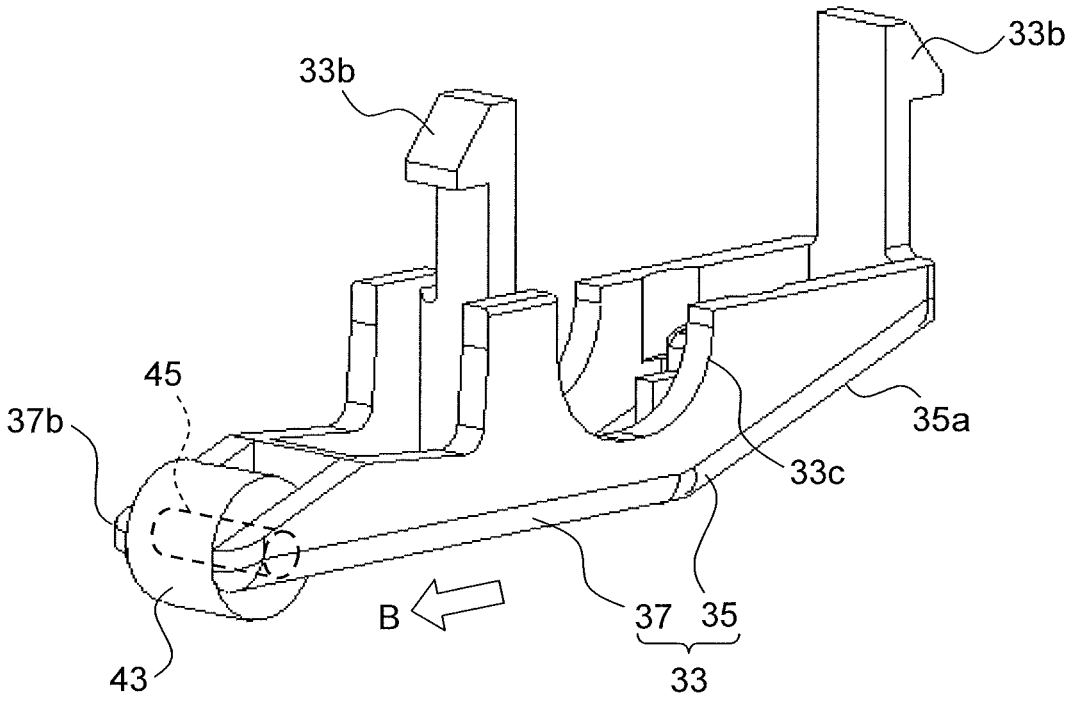
FIG. 12 is a perspective view of the corrugation member used in the sheet discharge device according to a fourth embodiment of the present disclosure.

FIG. 12 is a perspective view of a corrugation member 33 used in a sheet discharge device 30 according to a fourth embodiment of the present disclosure, as seen from the downstream side in the sheet discharge direction. In this embodiment, a downstream-side end part 37*b* of a second pressing part 37 is fitted with a following roll 43 (following rotary member). The following roll 43 is supported on a support shaft 45 provided at the downstream-side end part 37*b* so as to be rotatable forward and backward along the sheet discharge direction. In other respects, the corrugation member 33 here has the same structure as in the first embodiment.

With the construction according to this embodiment, owing to the downstream-side end part 37*b* of the second pressing part 37 being fitted with the following roll 43, when a sheet S is discharged, friction between the top face of the sheet S and the downstream-side end part 37*b* of the second pressing part 37 is reduced. Accordingly, it is possible, while retaining the effect of maintaining the corrugated shape by the second pressing part 37, to reduce damage to the sheet S.

The present disclosure may be implemented in any other manner than in the embodiments described above, and allows for many modification without departure from the spirit of the present disclosure. Any construction which is a combination of the embodiments described above is also within the scope of the present disclosure. For example, in the first to third embodiments, as in the fourth embodiment, a following roll 43 may be provided at a downstream-side end part 37*b* of the second pressing part 37.

Although in the above-described embodiments corrugation members 33 are provided at three places between four pairs of discharge roller pairs 17, the number of the corrugation members 33 can be as necessary changed to suit the number of discharge roller pairs 17. Forming engagement holes 50 outward of the discharge roller pairs 17 at both ends in the sheet width direction permits corrugation members 33 to be added to suit the size of the discharged sheet.

Needless to say, the present disclosure is applicable, not only to a monochrome printer as shown in FIG. 1, but also to any other type of image forming apparatuses such as color printers, monochrome and color copiers, digital multifunction peripherals, and facsimile machines, and to sheet post-processing devices combined with image forming apparatuses.

The present disclosure is applicable to sheet discharge devices that discharge blank sheets or documents in the form of sheets. Based on the present disclosure, it is possible to provide a sheet discharge device that effectively suppresses curling of a discharged sheet and that can reduce damage to a sheet and development of streaks, and to provide an image forming apparatus incorporating such a sheet discharge device.

What is claimed is:

1. A sheet discharge device comprising:

a sheet discharge port through which a sheet is discharged;

a conveying guide composed of a first conveying guide facing one side of the sheet and a second conveying guide facing an other side of the sheet, the conveying guide guiding the sheet to the sheet discharge port;

discharge roller pairs provided close to the sheet discharge and arranged at predetermined intervals in a sheet width direction perpendicular to a sheet discharge direction;

corrugation members arranged between the discharge roller pairs so as to protrude from a first conveying guide side to a second conveying guide side beyond a nip portion in the discharge roller pairs, the corrugation members stiffening the sheet by pressing one side of the sheet; and first biasing members supported on the first conveying guide, the first biasing members biasing the corrugation members in a protruding direction, wherein each of the corrugation members includes:

a first pressing part arranged in a region extending from an upstream side of the discharge roller pairs to a downstream-side end part of the discharge roller pairs in the discharge direction and including the nip portion, the first pressing part making contact with one side of the sheet;

a second pressing part arranged in a region further on a downstream side of the downstream-side end part of the discharge roller pairs in the discharge direction, the second pressing part making contact with one side of the sheet, the corrugation members have the second pressing part configured to be removably attached to the first pressing part and are supported on the first conveying guide so as to be movable in an up-down direction with the second pressing part integrally mounted on the first pressing part, a downstream-side end part of the first pressing part in the discharge direction has an arc-shaped convex part as seen from the width direction, an upstream-side end part of the second pressing part has an arc-shaped concave part fitting to the convex part, and the second pressing part is mounted on the first pressing part by fitting the concave part to the convex part.

2. The sheet discharge device according to claim 1, wherein the second pressing part is supported on the downstream-side end part of the first pressing part in the discharge direction so as to be swingable upward from a lower limit position where the second pressing part presses the sheet, and includes a second biasing member biasing the second pressing part toward the lower limit position.

3. The sheet discharge device according to claim 2, wherein a biasing force of the second biasing member is weaker than a biasing force of a respective one of the first biasing members.

4. The sheet discharge device according to claim 1, wherein a following rotary member is provided at a downstream-side end part of the second pressing part in the sheet discharge direction so as to be rotatable in the discharge direction while in contact with the sheet.

5. An image forming apparatus comprising:

the sheet discharge device according to claim 1; and an image forming portion arranged at an upstream side of the sheet discharge device in the discharge direction, the image forming portion forming an image on the sheet.

6. The sheet discharge device comprising:

a sheet discharge port through which a sheet is discharged;

a conveying guide composed of a first conveying guide facing one side of the sheet and a second conveying guide facing an other side of the sheet, the conveying guide guiding the sheet to the sheet discharge port;

discharge roller pairs provided close to the sheet discharge port and arranged at predetermined intervals in a sheet width direction perpendicular to a sheet discharge direction;

corrugation members arranged between the discharge roller pairs so as to protrude from a first conveying guide side to a second conveying guide side beyond a nip portion in the discharge roller pair the corrugation members stiffening the sheet by pressing one side of the sheet; and first biasing members supported on the first conveying guide, the first biasing members biasing the corrugation members in a protruding direction, wherein each of the corrugation members includes:

a first pressing part arranged in a region extending from an upstream side of the discharge roller pairs to a downstream-side end part of the discharge roller pairs in the discharge direction and including the nip portion, the first pressing part making contact with one side of the sheet;

a second pressing part arranged in a region further on a downstream side of the downstream-side end part of the discharge roller pairs in the discharge direction, the second pressing part making contact with one side of the sheet, the corrugation members have the second pressing part configured to be removably attached to the first pressing part and are supported on the first conveying guide so as to be movable in an up-down direction with the second pressing part integrally mounted on the first pressing part, the first pressing part has an inclined face inclining downward from an upstream side to a downstream side in the sheet discharge direction, a downstream-side end part of the inclined face protrudes to below the nip portion in the discharge roller pairs, and the second pressing part has a pressing face extending approximately horizontally from the downstream-side end part of the inclined face to a downstream side thereof.

7. A sheet discharge device to discharge and stack sheets onto a discharge tray sequentially comprising:

a sheet discharge port through which a sheet is discharged;

a conveying guide composed of a first conveying guide facing one side of the sheet and a second conveying guide facing an other side of the sheet, the conveying guide guiding the sheet to the sheet discharge port;

discharge roller pairs provided close to the sheet discharge port and arranged at predetermined intervals in a sheet width direction perpendicular to a sheet discharge direction;

corrugation members arranged between the discharge roller pairs so as to protrude from a first conveying guide side to a second conveying guide side beyond a nip portion in the discharge roller pairs, the corrugation members stiffening the sheet by pressing one side of the sheet; and first biasing members supported on the first conveying guide, the first biasing members biasing the corrugation members in a protruding direction, wherein each of the corrugation members includes:

a first pressing part arranged in a region extending from an upstream side of the discharge roller pairs to a downstream-side end part of the discharge roller pairs in the discharge direction and including the nip portion, the first pressing part making contact with one side of the sheet;

a second pressing part arranged in a region further on a downstream side of the downstream-side end part of the discharge roller pairs in the discharge direction, the second pressing part making contact with one side of the sheet, and the second pressing part is configured to be removably attached to the first pressing part, a downstream-side end part of the first pressing part in the discharge direction has an arc-shaped convex part as seen from the width direction, an upstream-side end part of the second pressing part has an arc-shaped concave part fitting to the convex part, and the second pressing part is mounted on the first pressing part by fitting the concave part to the convex part.

8. The sheet discharge device according to claim 7, wherein the second pressing part is supported on the downstream-side end part of the first pressing part in the discharge direction so as to be swingable upward from a lower limit position where the second pressing part presses the sheet, and includes a second biasing member biasing the second pressing part toward the lower limit position.

9. The sheet discharge device according to claim 8, wherein a biasing force of the second biasing member is weaker than a biasing force of a respective one of the first biasing members.

10. The sheet discharge device according to claim 7, wherein a following rotary member is provided at a downstream-side end part of the second pressing part in the sheet discharge direction so as to be rotatable in the discharge direction while in contact with the sheet.

11. The sheet discharge device according to claim 7, wherein the first pressing part has an inclined face inclining downward from an upstream side to a downstream side, a downstream-side end part of the inclined face protrudes to below the nip portion in the discharge roller pairs, and the second pressing part has a pressing face extending approximately horizontally from a downstream-side end part of the inclined face to a downstream side thereof.

12. An image forming apparatus comprising:

the sheet discharge device according to claim 7; and an image forming portion arranged at an upstream side of the sheet discharge device in the discharge direction, the image forming portion forming an image on the sheet.

* * * * *